US007571896B2

(12) United States Patent
Bonham

(10) Patent No.: US 7,571,896 B2
(45) Date of Patent: Aug. 11, 2009

(54) PRIVACY FENCE BORDER SYSTEM

(75) Inventor: Mervin Wade Bonham, Grand Rapids, MN (US)

(73) Assignee: Marvin W. Bonham, Grand Rapids, MN (US)

( * ) Notice: Subject to any disclaimer, the term of this patent is extended or adjusted under 35 U.S.C. 154(b) by 0 days.

(21) Appl. No.: 12/229,292

(22) Filed: Aug. 21, 2008

(65) Prior Publication Data

US 2009/0108246 A1 Apr. 30, 2009

Related U.S. Application Data

(63) Continuation-in-part of application No. 11/530,946, filed on Sep. 12, 2006, now abandoned.

(51) Int. Cl.
*E04H 17/16* (2006.01)

(52) U.S. Cl. ..... 256/27; 256/26; 256/67

(58) Field of Classification Search ..... 256/24, 256/26, 27, 67; 160/172 V; 49/74.1, 87.1, 49/92.1

See application file for complete search history.

(56) References Cited

U.S. PATENT DOCUMENTS

| | | | | | |
|---|---|---|---|---|---|
| 1,718,754 | A | * | 6/1929 | Molina | 49/92.1 |
| 2,607,090 | A | * | 8/1952 | Chartoff | 49/87.1 |
| 2,973,943 | A | * | 3/1961 | Loter et al. | 256/24 |
| 4,160,343 | A | * | 7/1979 | Hubbard | 49/90.1 |
| 4,709,506 | A | * | 12/1987 | Lukaszonas | 49/87.1 |
| 5,052,150 | A | * | 10/1991 | Chen | 49/82.1 |
| 2008/0087874 | A1 | * | 4/2008 | Ebeling | 256/67 |

FOREIGN PATENT DOCUMENTS

| | | | | |
|---|---|---|---|---|
| JP | 3-183877 | * | 8/1991 | 256/26 |

* cited by examiner

*Primary Examiner*—Michael P Ferguson

(57) ABSTRACT

A privacy fence border system for allowing a user to selectively close the fence for privacy and open the fence for increased visibility. The privacy fence border system includes a lower support, an upper support, a plurality of panels pivotally connected between the lower support and the upper support, an opening and closing mechanism connected to the lower end of the plurality of panels, and a handle inserted in the opening and closing mechanism. Manipulation of the handle allows for positioning of the panels in a closed state to increase privacy or an open state to increase visibility.

5 Claims, 8 Drawing Sheets

PRIVACY FENCE BORDER SYSTEM

CROSS REFERENCE TO RELATED APPLICATIONS

Continuation-in-part; patent application Ser. No. 11/530,946 filed Sep. 12, 2006 now abandoned.

STATEMENT REGARDING FEDERALLY SPONSORED RESEARCH OR DEVELOPMENT

Not applicable to this application.

BACKGROUND OF THE INVENTION

1. Field of the Invention

The present invention relates generally to fences and more specifically it relates to a privacy fence border system for allowing a user to selectively close the fence for privacy and open the fence for increased visibility.

2. Description of the Related Art

Any discussion of the prior art throughout the specification should in no way be considered as an admission that such prior art is widely known or forms part of common general knowledge in the field.

Fences have been in use for years. Some fences are constructed of a plurality of vertical poles or boards distally spaced apart to allow partial viewing through the fences but they also allow third-parties to view inside of the fence thereby reducing privacy. Other fences are constructed of a plurality of vertical boards adjacent to one another thereby preventing third-parties from viewing inside of the fence but they also unfortunately prevent the property owner from viewing outside of the fence. Conventional fences are static in structure thereby not accommodating to a property owner's desire to either have privacy or open viewing.

While these devices may be suitable for the particular purpose to which they address, they are not as suitable for allowing a user to selectively close the fence for privacy and open the fence for increased visibility. Conventional fences do not allow for selective opening and closing of the fence structure for increasing visibility or increasing privacy respectively.

In these respects, the privacy fence border system according to the present invention substantially departs from the conventional concepts and designs of the prior art, and in so doing provides an apparatus primarily developed for the purpose of allowing a user to selectively close the fence for privacy and open the fence for increased visibility.

BRIEF SUMMARY OF THE INVENTION

In view of the foregoing disadvantages Inherent In The known Types of fences now present in the prior art, the present invention provides a new privacy fence border system construction wherein the same can be utilized for allowing a user to selectively close the fence for privacy and open the fence for increased visibility.

The general purpose of the present invention, which will be described subsequently in greater detail, is to provide a new privacy fence border system that has many of the advantages of the fences mentioned heretofore and many novel features that result in a new privacy fence border system which is not anticipated, rendered obvious, suggested, or even implied by any of the prior art fences, either alone or in any combination thereof.

To attain this, the present invention generally comprises a lower support, an upper support, a plurality of panels pivotally connected between the lower support and the upper support, a pulley and gear system inside the lower support, and a handle connected to the gear system. Manipulation of the handle Allows for positioning of the panels in a closed state for privacy or an open state to increase visibility.

There has thus been outlined, rather broadly, the more important features of the invention in order that the detailed description thereof may be better understood, and in order that the present contribution to the art may be better appreciated. There are additional features of the invention that will be described hereinafter and that will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of the description and should not be regarded as limited.

A primary object of the present invention is to provide a privacy fence border system that will overcome the shortcomings of the prior art devices.

A second object is to provide a privacy fence border system for allowing a user to selectively close the fence for privacy and open the fence for increased visibility.

Another object is to provide a privacy fence border system that may be utilized as a deck fence An additional object is to provide a privacy fence border system that is comprised of a simple structure.

A further object is to provide a privacy fence border system that may have various sizes and lengths.

Another object is to provide a privacy fence border system that may be closed to keep wind out of a yard.

Other objects and advantages of the present invention will become obvious to the reader and it is intended that these objects and advantages are within the scope of the present invention.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWINGS

Various other objects, features and attendant advantages of the present invention will become fully appreciated as the same becomes better understood when considered in conjunction with the accompanying drawings, in which like reference characters designate the same or similar parts throughout the several views, and wherein.

DETAILED DESCRIPTION OF THE INVENTION

A. Overview

Figure 1:
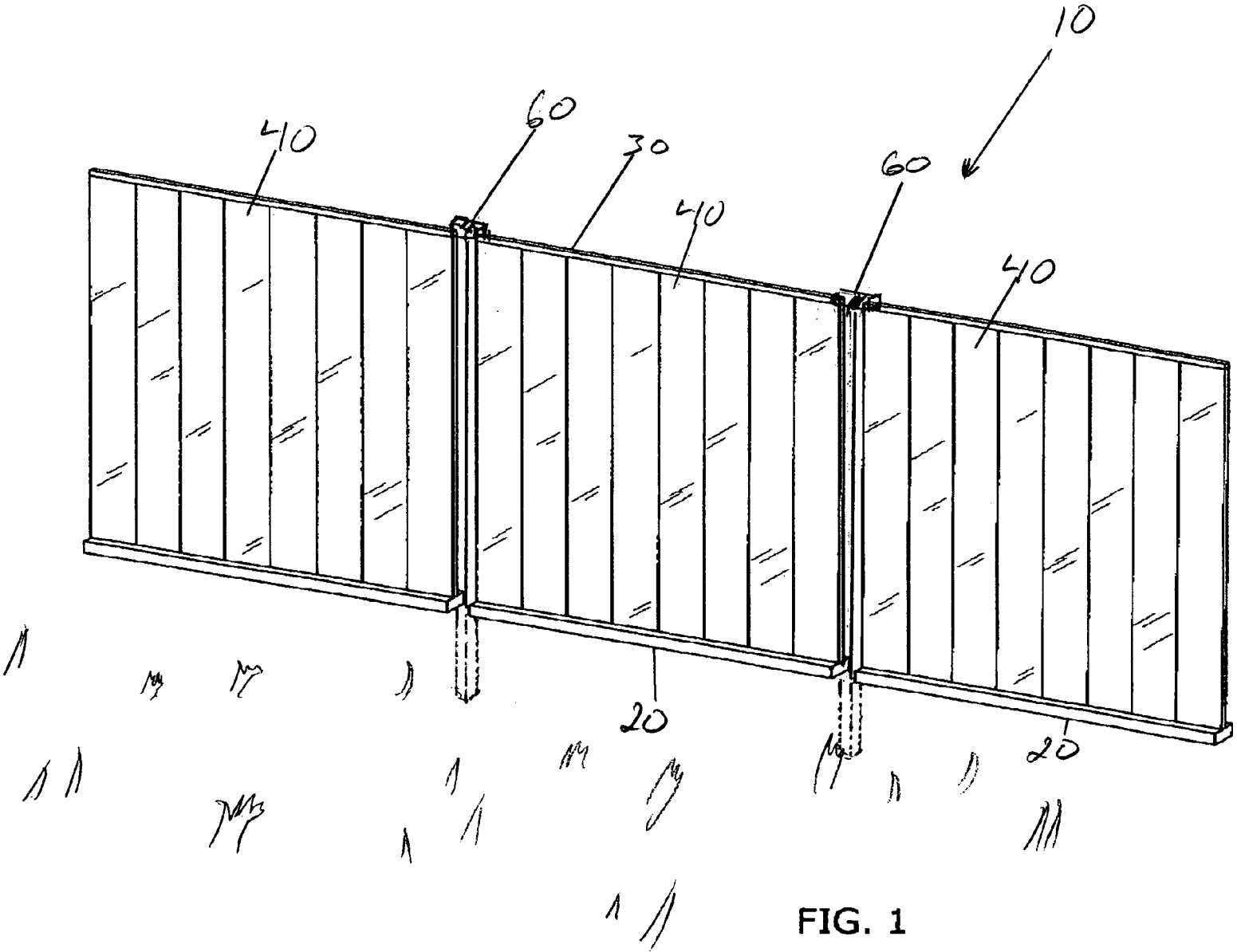
FIG. 1 is an upper view of the present invention in a closed state.

Turning now descriptively to the drawings, in which similar reference characters denote similar elements throughout the several views, FIGS. 1 through 7 illustrate a privacy fence border system 10, which comprises a lower support rail 20, an upper support rail 30, a plurality of panels 40, pivotally connected between the lower support 20, and the upper support 30, an opening and closing mechanism 50, connected to the lower end of the plurality of panels 40, and a handle 52, inserted in the opening closing mechanism 50. Manipulation of the handle 52 allows for the positioning of the panels 40 in a closed state to increase privacy or an open state to increase visibility.

B Lower Support

FIGS. 1 through 4 illustrate the lower support 20 and the upper support 30 opposite of the lower support 20. The lower support 20 is comprised of an elongated structure sufficient in length to accommodate a sufficient length of panels 40 (e.g. 4 feet, 6 feet, 8 feet, etc. ). The lower support 20 may be comprised of various material types such as but not limited to wood, metal, and plastic.

C Upper Support

FIGS. 1 through 4 illustrate the upper support 30 which is opposite of the lower support 20 The upper support 30 is comprised of an elongated structure sufficient in length to accommodate a sufficient length of panels 40 (4 feet, 6 feet, 8 feet, etc.). It is preferable that the length of the upper support 30 equal the length of the lower support 20 to create a section that may be installed at a residence.

One or more support poles 60 are inserted into the ground surface and secured between ends of the sections to support the sections of the present invention as illustrated in FIG. 1 of the drawings. The lower support 20 may be comprised of various material types such as but not limited to wood, metal and plastic.

D. Panels

The plurality of panels 40 are pivotally connected between the lower support 20 and the upper support 30 to allow for rotation of the panels 40 about their longitudinal axis. The plurality of panels 40 are each preferably vertically aligned and are preferably substantially parallel to one another to allow for a uniform appearance and for substantially obstructing visibility when in a closed state.

Figure 2:
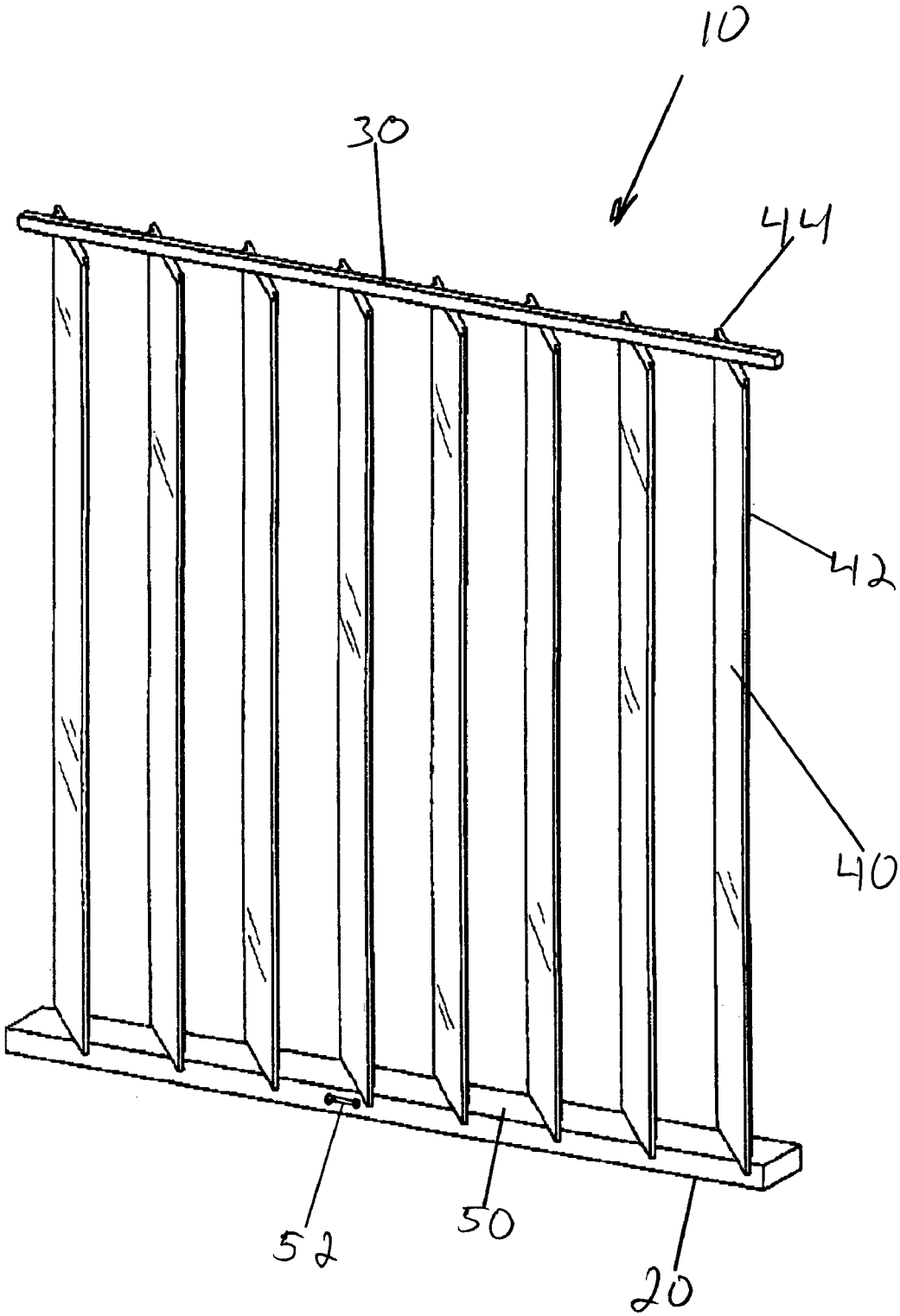
FIG. 2 is an upper perspective view of the present invention in a partially open state.
Figure 3:
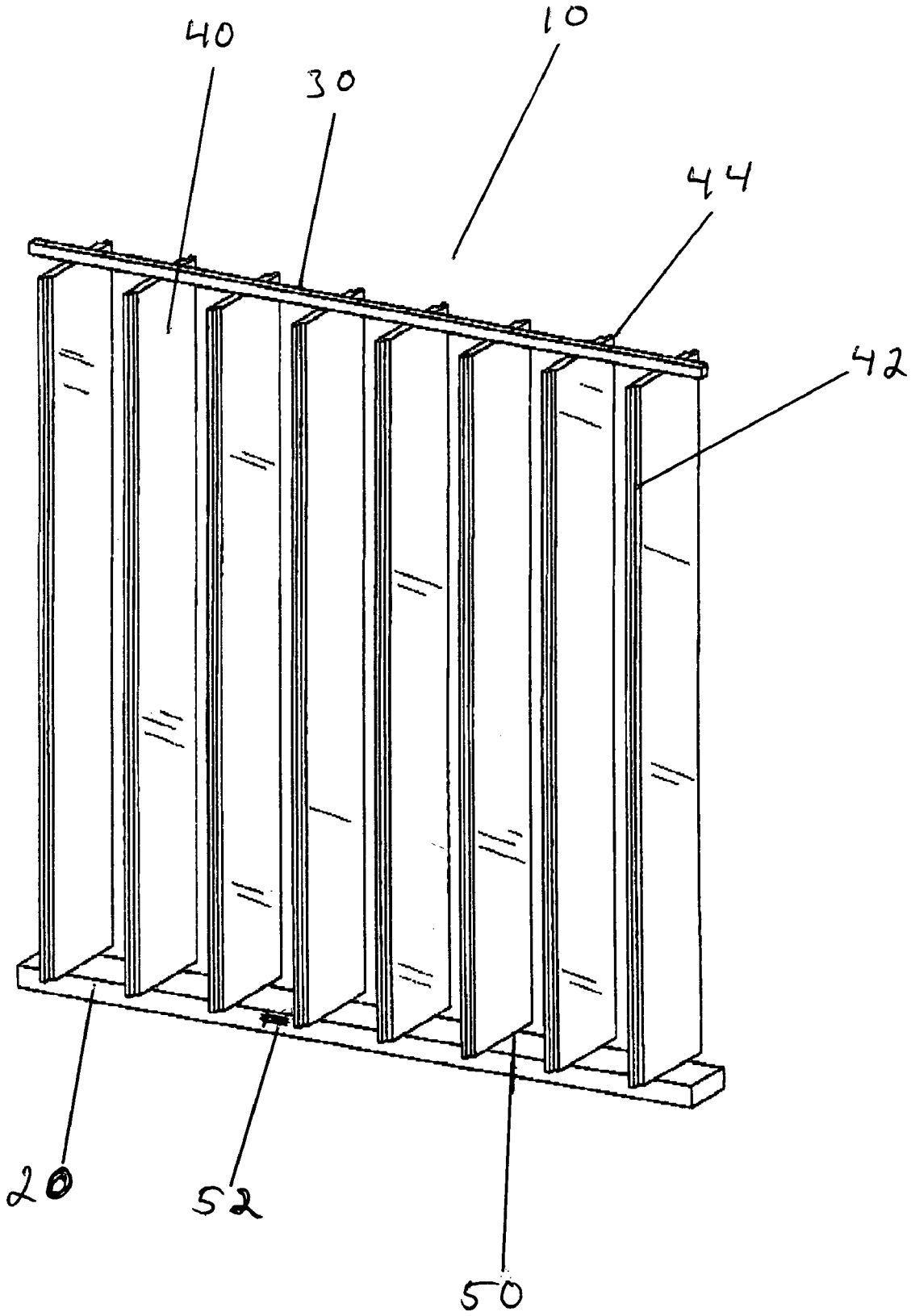
FIG. 3 is an upper perspective view of the present invention in an open state.

The plurality of panels 40 are distally spaced apart from one another in an equidistant manner which is preferably equal to the approximate width of the panels 40. The panels 40 are each preferably comprised of the same width, length, thickness and material type. The plurality of panels 40 are each preferably comprised of a flat structure as best illustrated in FIGS. 1 through 3 of the drawings. The plurality of panels 40 are each preferably comprised of a solid and non-porous material to allow for reduction of visibility and wind in the closed state.

Figure 5:
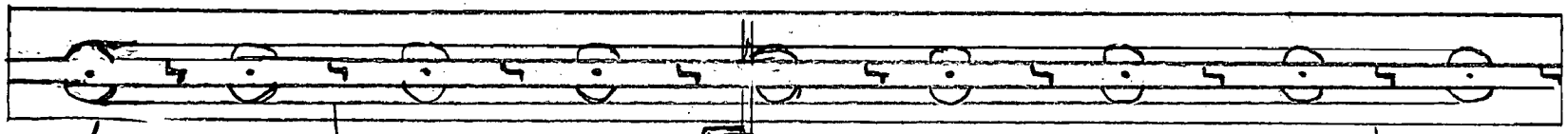
FIG. 5 is a top view of the present invention in the closed state.
Figure 6:
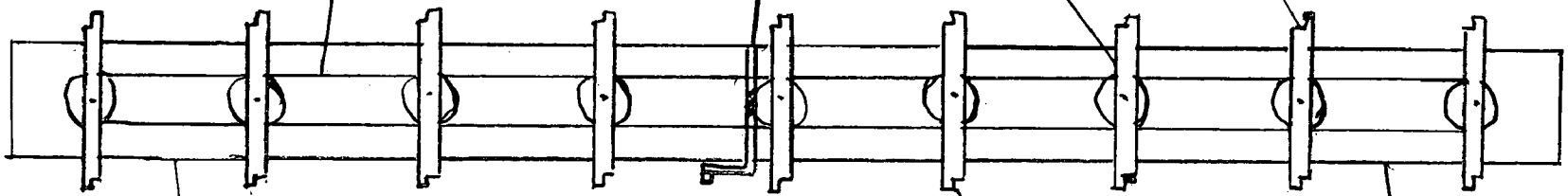
FIG. 6 is a top view of the present invention in the open state.
Figure 7:
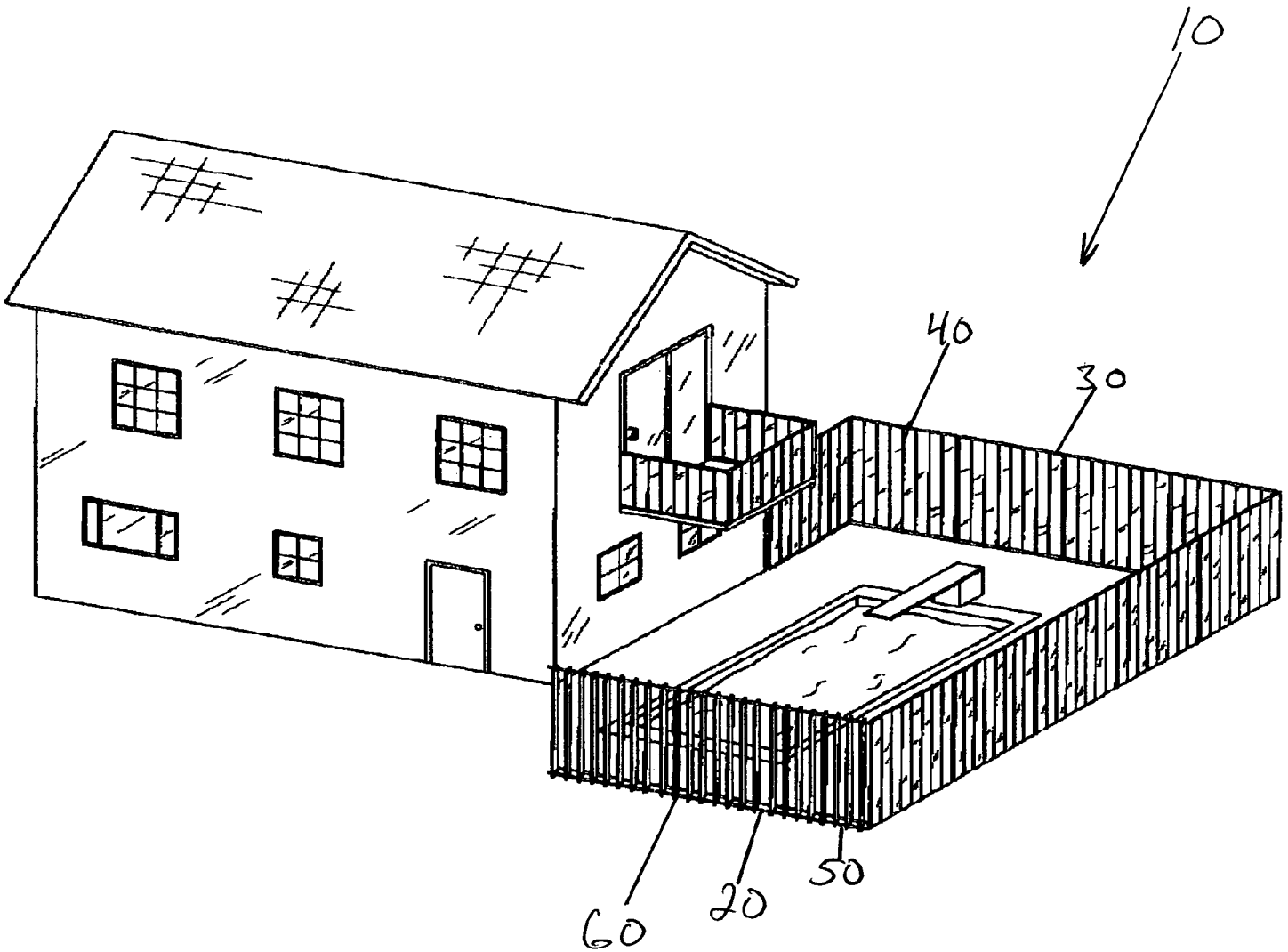
FIG. 7 is an upper perspective view of the present invention utilized as a fence in a backyard of a home with a portion open and another portion closed along with the present invention utilized as a deck fence in a closed state.

The plurality of panels 40 each have a pivot point that is preferably centrally located along a longitudinal axis of each of the plurality of panels 40 as best illustrated in FIGS. 5 and 6 of the drawings. The panels 40 are pivotally connected to the opening and closing mechanism 50 inside the lower support 20 and the upper support 30 with pins on top and shear pins on bottom.

Figure 4:
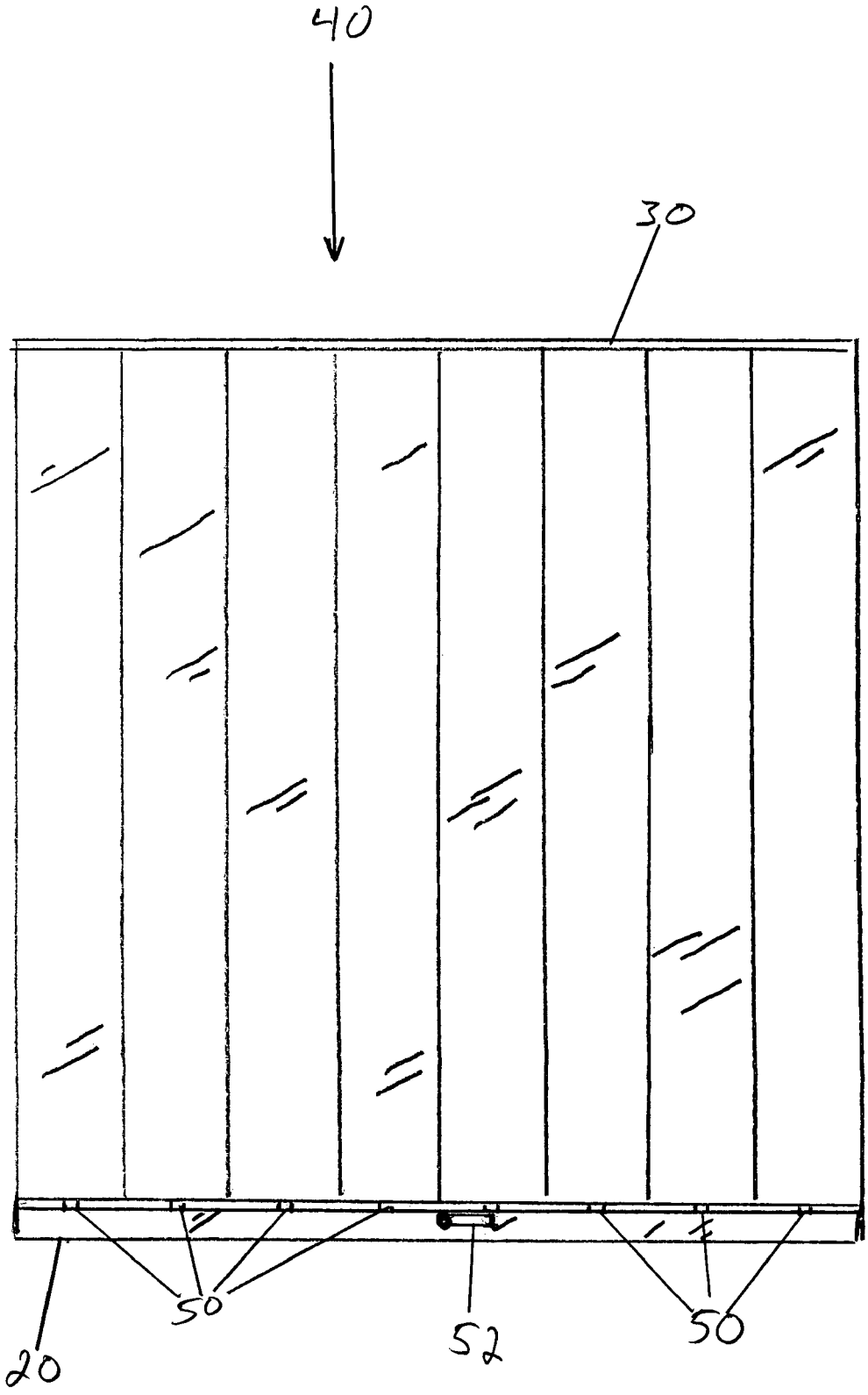
FIG. 4 is a front view of the present invention in a closed state.

Opposing sides of the plurality of panels 40 are preferably positioned adjacent to one another when in a closed state to substantially block viewing through the plurality of panels 40 as shown in FIGS. 1 and 4 of the drawings. The plurality of panels 40 each preferably include a first stepped edge 42 and a second stepped edge 44 that are opposite of one another as illustrated in FIGS. 2,3 and 6 of the drawings. The first stepped edge 42 of the first panel fits in an overlapping manner with the second stepped edge 44 of a second panel with this process continuing for each adjacent panel.

The first stepped edge 42 and the second stepped edge 44 each are preferably approximately half the thickness of the plurality of panels 40 thereby allowing the appearance of a solid interlocking fence when in the closed state as shown in FIG. 1 of the drawings.

E. Opening and Closing Mechanism

Figure 8:
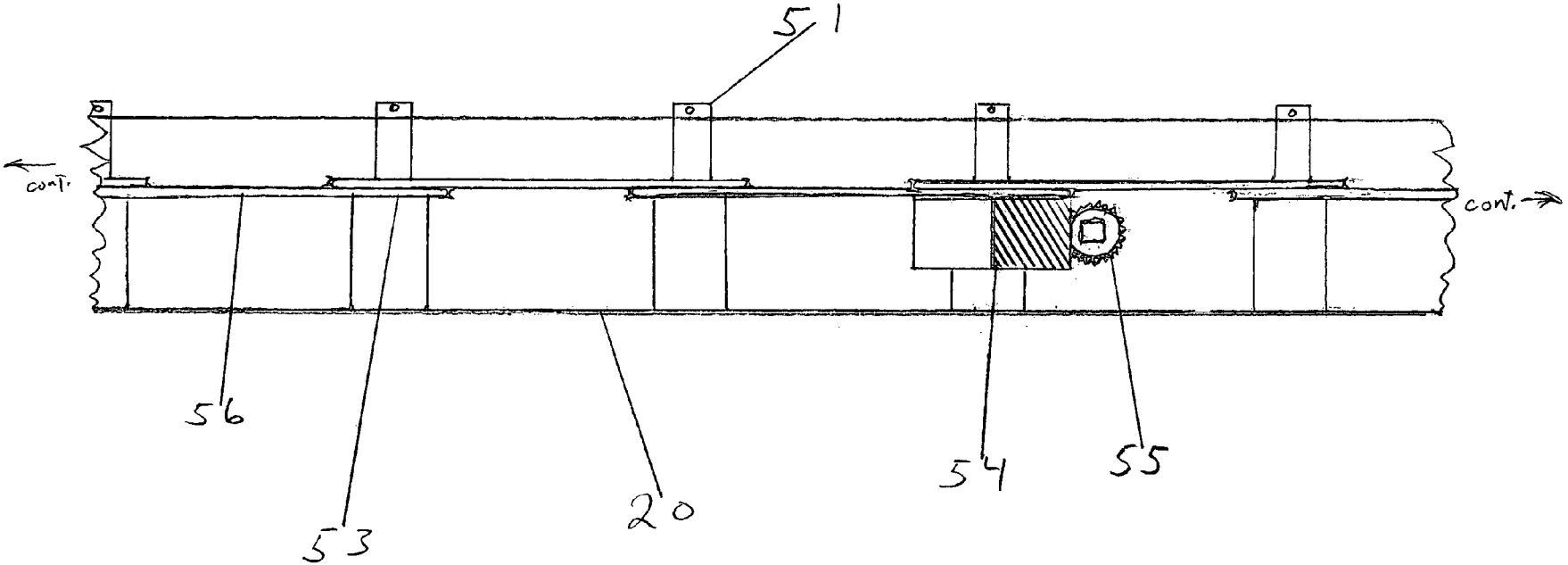
FIG. 8 is a front view of the present inventions opening and closing mechanism.
Figure 9:
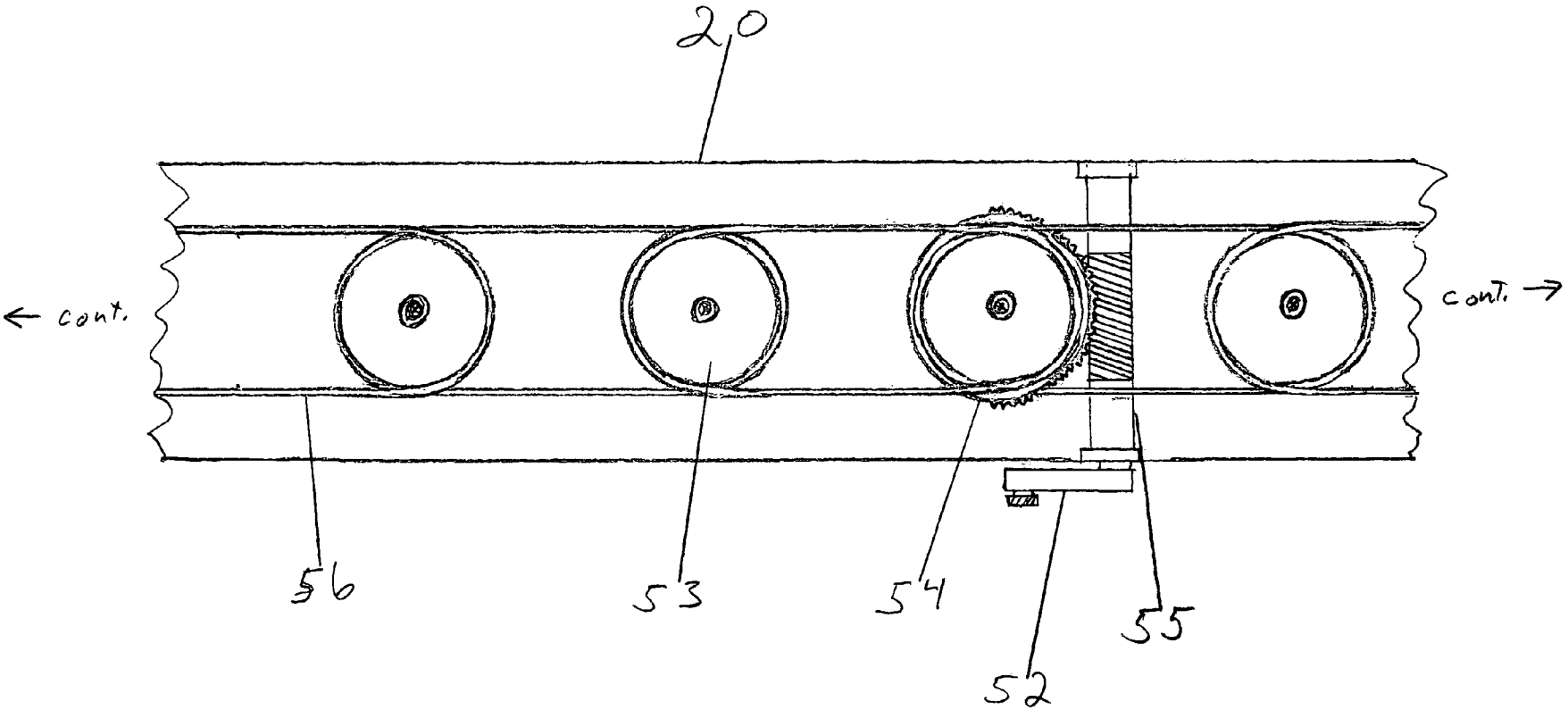
FIG. 9 is a top view of the present inventions opening and closing mechanism.

The Opening and closing mechanism 50 is connected to the plurality of panels 40 as shown in FIGS. 5 and 6 of the drawings. The opening and closing mechanism 50 is preferably connected to a lower end of the plurality of panels 40 with attachments 51 protruding through the top of the lower support 20. the opening and closing mechanism 50 is preferably located inside of lower support 20 as illustrated in FIGS. 8 and 9 of the drawings. The opening closing mechanism 50 is preferably substantially parallel to the upper support 30 and the lower support 20. The attachments 51 are connected to double pulleys 53 which are spaced distally apart from one another in an equidistant manner which is preferably equal to the approximate width of the panels 40. The double pulleys 53 are connected together and operate with rubber, or other such material, belts or bands 56 connected together as best illustrated in FIGS. 8 and 9 so as to each turn in the same direction and position.

The pulleys 53 are then connected preferably, but not limited to, the center pulley-gear assembly 54 which in turn is operated with a worm gear shaft 55 that is connected at an 90 degree angle to the lower support 20 as best illustrated in FIGS. 5, 6, and 9. A handle 57 is then inserted into the end of the worm gear 55. Rotation of the handle, or electric motor, manipulates the state of the panels 40

F. Operation of the Invention

In use, one or more sections of the present invention are installed to a deck or a yard of a home. If a plurality of sections are installed, an appropriate number of support poles 60 are attached between the sections to the upper support 30 and lower support 20 of each section.

If the user desires increased visibility, the user manipulates the handle 52 so that the panels 40 are rotated at an angle with respect to the upper support 30 and the lower support 20. For example the user may turn the handle 52 so that the panels 40 are transverse with respect to the upper support 30 and the lower support 20 as best illustrated in FIG. 6 of the drawings. If the user desires to reduce visibility into their yard or other area, the handle 52 is manipulated such that the panels 40 are substantially parallel with respect to the upper support 30 and the lower support 20 as illustrated in FIG. 5 of the drawings. Various intermediary positions are achievable by rotating the handle 52 accordingly as illustrated in FIG. 2 of the drawings.

What has been described and illustrated herein is a preferred embodiment of the invention along with some of its variations. The terms, descriptions and figures used herein are set forth by way of illustration only and are not meant as limitations. Those skilled in the art will recognize that many variations are possible within the spirit and scope of the invention, which is intended to be defined by the following claims (and their equivalents) in which all terms are meant in their broadest reasonable sense unless otherwise indicated. Any headings utilized within the description are for convenience only and have no legal or limiting effect.

I claim:

1. A privacy fence border system, comprising:

a pair of support poles inserted into a ground surface;

a lower support rail and an upper support rail supported by said support poles;

a plurality of panels pivotally connected between said lower support rail and said upper support rail, wherein said plurality of panels are each vertically aligned and are substantially parallel to one another;

wherein said plurality of panels are distally spaced apart from one another in an equidistant manner;

wherein said plurality of panels each have a pivot point that is centrally located along a longitudinal axis of each of said plurality of panels, said plurality of panels being simultaneously pivoted about said pivot points between an open state and a closed state;

wherein opposing sides of adjacent panels abut one another when in said closed state to substantially block viewing through said plurality of panels; and an opening and closing mechanism inside said lower support rail and connected to lower ends of the plurality of panels for pivoting said panels between said open state and said closed state, said opening and closing mechanism comprising:

a plurality of connectors protruding through said lower support rail, each of said plurality of connectors attached to a respective panel for pivoting said panel when said connectors are rotated;

a plurality of double pulleys distally spaced apart from one another in an equidistant manner along an interior of said lower support rail, each of said pulleys being connected to a respective connector for rotating said connector when said pulleys are rotated;

a plurality of pulley belts, each of said belts operatively engaging a pair of adjacent double pulleys such that the plurality of belts are rotated simultaneously in the same direction in order to simultaneously rotate said plurality of pulleys;

a center pulley-gear connected to one of said plurality of pulleys for rotating said one pulley, rotation of said one pulley simultaneously rotating a pair of attached pulley belts;

a worm gear operatively engaging said center pulley-gear for rotating said center pulley gear; and a handle removably inserted into an end of said worm gear for rotating said worm gear.

2. The privacy fence border system of claim 1, wherein said plurality of panels are each comprised of a flat structure.

3. The privacy fence border system of claim 1, wherein said plurality of panels are each comprised of a solid and non-porous material.

4. The privacy fence border system of claim 1, wherein said plurality of panels each include a first stepped edge and a second stepped edge that are opposite of one another, wherein first stepped edge of a first panel fits in an overlapping manner with said second stepped edge of a second panel.

5. The privacy fence border system of claim 4, wherein said first stepped edge and second stepped edge are approximately half the thickness of said plurality of panels.

* * * * *